US005348486A

United States Patent [19]

Tura, Jr. et al.

[11] Patent Number: 5,348,486

[45] Date of Patent: Sep. 20, 1994

[54] HEAT SHIELDED SPARK PLUG BOOT ASSEMBLY

[75] Inventors: Vincent J. Tura, Jr.; Kenneth B. Germ, both of Niles, Ohio

[73] Assignee: General Motors Corporation, Detroit, Mich.

[21] Appl. No.: 104,697

[22] Filed: Aug. 11, 1993

[51] Int. Cl.[5] ..... H01R 13/533

[52] U.S. Cl. ..... 439/125

[58] Field of Search ..... 439/125–128, 439/906, 904, 905, 607, 901, 485

[56] References Cited

U.S. PATENT DOCUMENTS

| | | | |
|---|---|---|---|
| 1,988,859 | 1/1935 | Shumaker | 439/320 |
| 2,301,572 | 11/1942 | Nowosielski | 439/126 |
| 4,497,532 | 2/1985 | Bezusko et al. | 439/607 |
| 4,671,586 | 6/1987 | DeBolt | 439/126 |
| 4,789,357 | 12/1988 | Yamaguchi et al. | 439/901 |
| 5,163,838 | 11/1992 | Tura, Jr. et al. | 439/126 |

*Primary Examiner*—Gary F. Paumen
*Attorney, Agent, or Firm*—William A. Schuetz

[57] ABSTRACT

A heat shielded spark plug boot assembly for an ignition cable connector comprises an L-shaped tubular, elastomeric boot having a cable end portion for receiving an ignition cable, a seal end portion for receiving a spark plug and sealing around its outer insulated part and an intermediate cavity portion for housing a terminal for connection with the spark plug. An L-shaped heat shield is stamped from flat metal heat stock and then bent and formed to provide a pair of spaced apart, generally parallel L-shaped sides, a back side having an inwardly indented semi-circular upper end and with the sides at their upper ends being rolled on the semi-circular upper end of the back and toward and into engagement with each other to form a semi-circle and longitudinal seam at their free edges. The upper portion of one side has a tab whose free end is received within a complementary shaped recess of the other upper end of the other side so as to interlock the two sides together. The boot is assembled to the heat shield by press fitting the same therein through the open side of the shield and snapping the boot past a pair of indents on the sides of the heat shield.

5 Claims, 2 Drawing Sheets

HEAT SHIELDED SPARK PLUG BOOT ASSEMBLY

The present invention relates to an ignition cable connector assembly, and more particularly, to an ignition cable connector assembly having an L-shaped elastomeric boot for housing an ignition terminal and a stamped, metal, L-shaped heat shield surrounding the boot and which is adapted to be electrically grounded to the metal shell of a spark plug.

Ignition cable connector assemblies commonly comprise a tubular elastomeric boot having a cable end portion for receiving an ignition cable, an intermediate cavity portion for housing a terminal which is secured to one end of the ignition cable and a seal end portion for receiving a spark plug and sealing around its outer insulator part. These elastomeric boots can either be linear in which the cable end and seal end portions thereof are aligned or be formed so that the cable end portion and seal end portion are either angled or at right angles to each other so as to be L-shaped.

While these ignition cable connector assemblies have been highly successful in use, they can deteriorate or have a shortened useful life when exposed to very high operating temperatures in an engine compartment, since they are often located near the engine exhaust manifold or other hot spots in the engine compartment. This is true even when high temperature elastomers, such as silicone are used. In such applications, the temperature capability of an elastomeric boot can be increased by the use of a metal heat shield which dissipates heat from any close hot spots in the engine compartment and tends to uniformly distribute the heat around the elastomeric boot. These metal heat shields also contact the metal bases of spark plug to transfer heat to the massive and cooler engine block to enhance heat shielding effectiveness.

Examples of such heat shields are shown in U.S. Pat. Nos. 4,497,532; 4,671,586 and 5,163,838, all of which are assigned to the same assignee as the present invention. The heat shields disclosed in these patents are cylindrical and surround the linear elastomeric boots containing a spark plug connector terminal and they are electrically grounded to a metal shell of the spark plug. In these heat shields, the ignition cable boots are merely inserted into the heat shield.

It is also known to provide metal shields which are L-shaped tubes or elbows, such as shown in U.S. Pat. No. 1,988,859, and 2,301,572. These metal elbow heat shields cannot, however, be used with a preformed L-shape elastomeric boot since such a boot could not be inserted into such an elbow.

Accordingly, it is a broad object of the present invention to provide a new and improved stamped, sheet metal heat shield for a preformed L-shaped ignition cable boot for a spark plug. It is a further object to provide such a heat shield which can be snap fittingly connected to a preformed L-shaped boot, is of an economical and simple construction, and which can be readily made from stamped metal stock.

In accordance with the provisions of the present invention, the heat shield is stamped from aluminum sheet metal and then bent and formed to provide a pair of spaced apart, generally parallel L-shaped sides and a back side having a semi-circular upper end indented slightly inwardly. The sides at their upper ends are then rolled toward and into engagement with each other to form a semi-circle and a longitudinal seam at their free edges, and with the upper ends engaging the semi-circular upper end of the back. The upper end of one side has a tab whose free end is wider than its base and the upper end of the other side has a complementary shaped recess whose bottom is wider than its mouth so that the tab will be received in the recess when the upper ends of the two sides are rolled toward each other to form a semicircle to interlock the two sides together and prevent separation. The elastomeric boot is connected to the heat shield by merely pressing the same between the two sides and into engagement with the back and the upper ends of the sides. The boot is retained within the heat shield by a pair of indents in the sides of the heat shield after the cable receiving end of the L-shaped boot is deflected and pressed therepast and into engagement with the back of the heat shield.

The heat shield also has a pair of forwardly extending ears for engaging the metal shell of the spark plug to provide a ground path and a heat conductive path. In addition, the spark plug connector assembly, preferably employs a dielectric material which surrounds the L-shaped boot to increase the dielectric strength of the assembly sufficiently to prevent troublesome electrical discharges, such as corona discharges, through the elastomeric boot while avoiding any need for increasing the thickness of the elastomeric boot.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
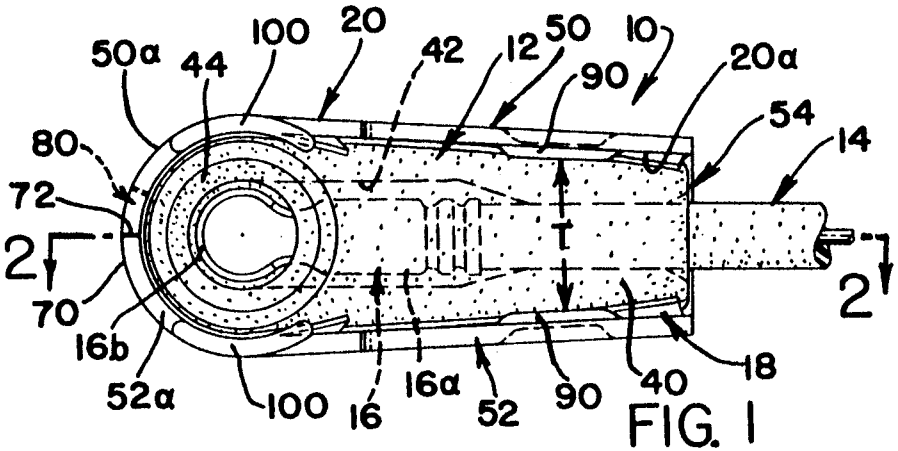
FIG. 1 is an end elevational view of a heat shielded spark plug boot assembly for a spark plug connector in accordance with the preferred embodiment of the present invention.
Figure 2:
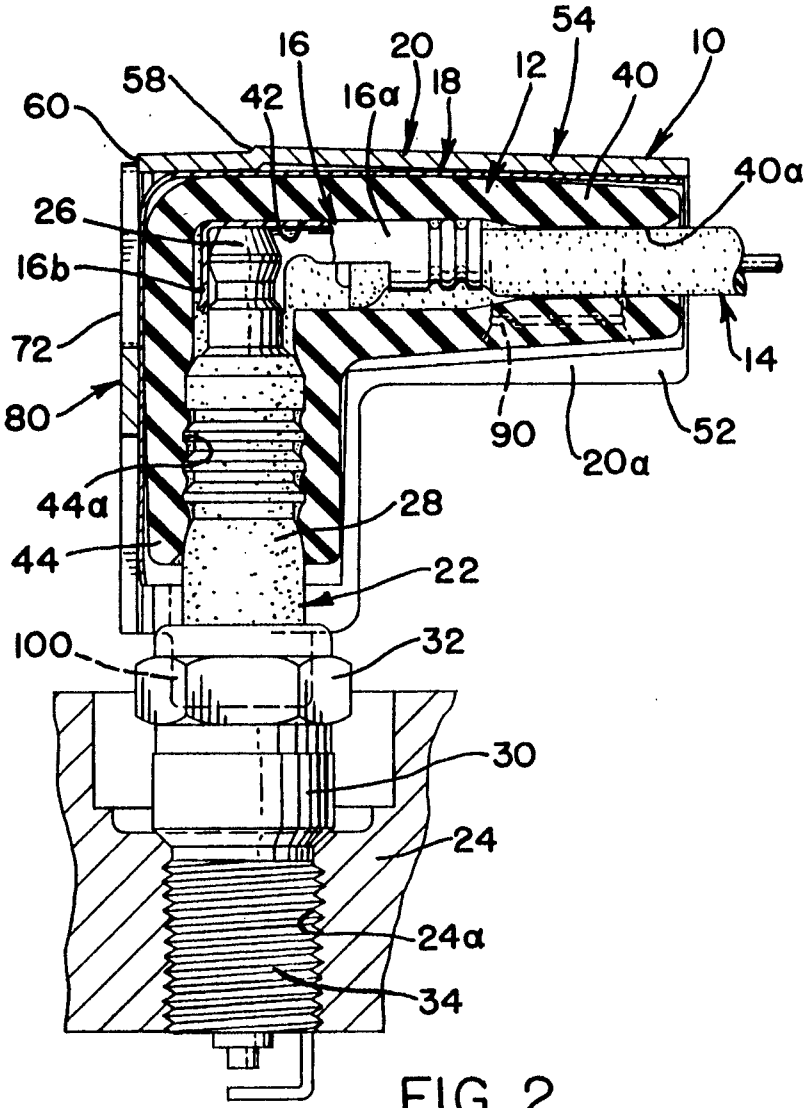
FIG. 2 is a cross sectional view taken approximately along lines 2—2 of FIG. 1, but showing the spark plug boot assembly connected to a spark plug which in turn is connected to an engine block.
Figure 4:
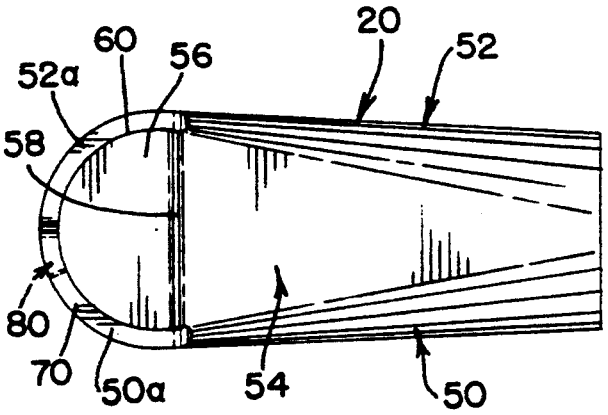
FIG. 4 is an end elevational view looking in the direction of the arrows 4—4 of FIG. 3.
Figure 5:
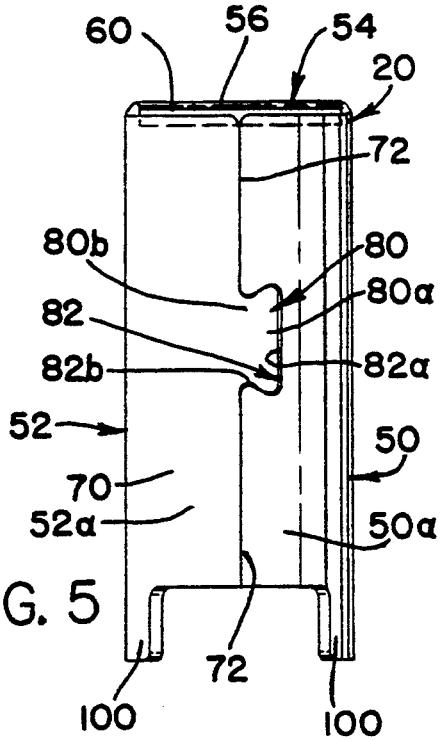
FIG. 5 is a top plan view of the heat shielded spark plug boot assembly shown in FIG. 3.

Referring to FIGS. 1 and 2 of the drawings, a heat shielded spark plug boot assembly 10 is thereshown. The heat shielded spark plug boot assembly 10 comprises, in general, an elastomeric boot 12, an ignition cable 14, a socket terminal 16, a dielectric barrier 18 and a heat shield 20 surrounding the boot 12. The heat shielded spark plug assembly 10 is adapted to be connected to a spark plug 22 which in turn is threadably secured to an engine block 24.

The ignition cable 14 is a conventional high energy T.V.R.S. (television-radio-suppression cable) which has a non-metallic conductive core and a high temperature silicone insulation jacket. The socket terminal 16 is a metal terminal and has one end 16*a* which is attached to the end of the ignition cable 14 by a conventional strip and fold technique. The terminal 16 at its other end 16*b* is at right angles to the end 16a and can be of any suitable or conventional socket design for connection to a conventional stud terminal 26 of the spark plug 22.

The spark plug 22 is likewise of a conventional design and standard configuration. It comprises the stud terminal 26 which plugs into the socket terminal end 16b of the terminal 16, a ceramic insulator 28 and a metal base 30 having a hex head 32 and a threaded shank 34 which is threadably connected to a threaded opening 24*a* in the engine block 24.

As best shown in FIG. 2, the elastomeric spark plug boot 12 is preformed so as to be L-shaped, that is, it is a 90′ or right angle elastomeric boot. The boot 12 has a cable end portion 40, an intermediate cavity portion 42 and a seal end portion 44. The elastomeric boot 12 is tubular throughout and the cable end portion has an opening 40*a* which is sized so as to sealingly engage around the outer silicone jacket of the ignition cable 14. The intermediate cavity portion 42 is L-shaped and somewhat larger than the opening 40*a* to provide room for the right angled socket terminal 16 attached to the end of the ignition cable 14. The seal end portion 44 has an opening 44*a* which is sized to sealingly engage around the ceramic insulator 28 of the spark plug 22, as shown in FIG. 2.

Figure 3:
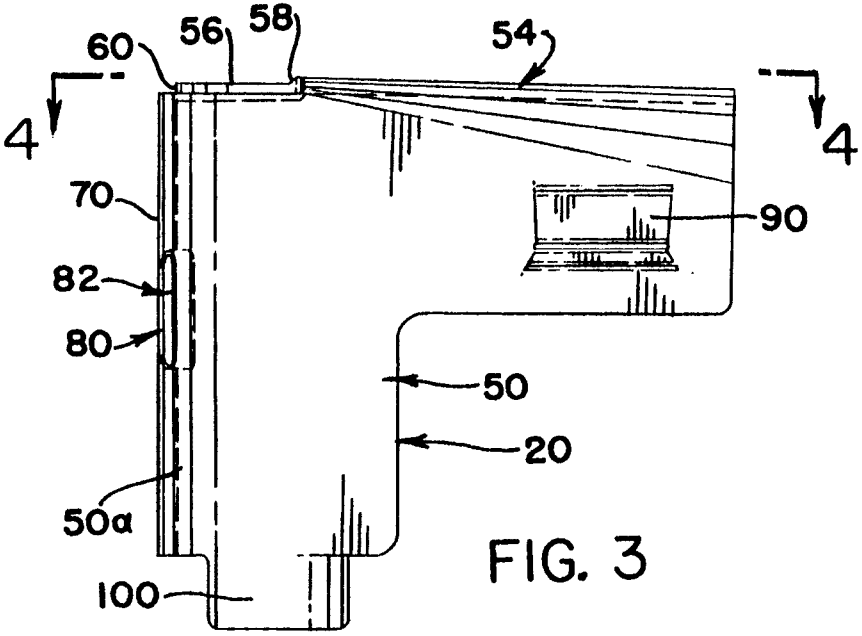
FIG. 3 is a side elevational view of the heat shielded spark plug boot assembly of FIG. 1 portions broken away and shown in section.

The heat shield 20 is made from aluminum sheet metal stock. The heat shield 20 is initially stamped to the configuration shown in FIG. 6. The flat stamping is then folded or bent and rolled to the finalize the shape of the heat shield 20, ,as shown in FIGS. 1–5. The heat shield 20 comprises a pair of inverted L-shaped sides 50, 52 as viewed in side elevation as shown in FIG. 3. The sides extend generally parallel to each other and are planar. The heat shield also has a back or back side 54 extending transversely of the sides 50, 52. The back 54 has an upper end 56 which is indented inwardly slightly as indicated by reference numeral 58 in FIG. 3, and for a reason to be hereinafter more fully described. The upper end 56 of the back 54 is planar, semi-circular in shape and defines an outer edge surface 60. The sides 50, 52 at their upper ends or end portions 50*a*, 52*a* are rolled towards each other to form a semicircle, as indicated by reference numeral 70 in FIG. 1. These upper ends 50, 50*a* of the sides 50, 52 engage and follow the contour of the semi-circular edge surface 60 of the upper end 56 of the back 54 when rolled toward each other. The edge surface 60 thus prevents the upper ends 50*a*, 52*a* from being rolled too far. The upper ends 50*a*, 52*a* engage each other to form a longitudinal seam 72.

The upper ends 50*a*, 52*a* of the sides 50, 52 when rolled into engagement with each other are interlocked via a tab 80 and recess 82. That is, the side 52 has a tab 80 extending transversely of the seam 72. The tab 80 at its free end 80*a* is wider than at its base 80*b*. The upper end 50*a* of the side 50 has a complementary shaped recess 82 whose bottom 82*a* is wider than its mouth 82*b*. When the upper ends 50*a*, 52*a* are rolled towards each other, the tab 82 is rolled into the recess 80 to interlock the two sides 50, 52 together and to prevent their being pulled apart or separated. It should be noted that as a result of the engagement of the upper ends 50*a*, 52*a* with the semi-circular surface 60 of the upper end 56 of the back 54, and the engagement between the upper ends 50*a*, 52*a* at the seam 72, that a substantially tight enclosure is formed. The sides 50, 52*a*, back 54 and the upper ends 50*a*, 52*a* thus form a three-sided enclosure or heat shield 20, the heat shield 20 having an open side 20*a* for receiving the L-shaped elastomeric boot 12. The heat shield 20 surrounds the elastomeric boot 12 for approximately 270′ of its circumference.

The elastomeric boot 12 is attached to the heat shield 20 by merely pressing the same into the heat shield 20 from the open side 20a. To retain the elastomeric boot within the heat shield, the sides 50, 52 are provided with a pair of indents 90. As best shown in FIG. 1, the transverse distance T between the indents 90 is less than the diameter of the cable receiving portion 40 of the elastomeric boot 12. Thus, when the elastomeric boot 12 is inserted into the heat shield 20 from the open side 20*a*, the elastomeric cable receiving end 40 will deflect and then snap behind the indents 90. The indents 90 retain and hold the boot 12 in place in the heat shield 20.

Preferably, the heat shield of the elastomeric boot assembly 10 would also include a dielectric barrier 18. The dielectric barrier 18, as illustrated in FIG. 1, could be a thin, high temperature dielectric material which extends around the sides and back of the elastomeric boot 20 throughout its length or extent and, preferably, somewhat past the seal end portion 44, as shown in FIG. 2. The dielectric material could be a laminate consisting of an inner Kapton film layer of 0.08 mm (3 mils) thickness and an outer Nomex paper layer of 0.05 mm (2 mils) thickness. Kapton is a trademark for the polyimide films of DuPont, while Nomex is DuPont's trademark for heat resistant aromatic polyamide fibers.

It is also possible to use other high temperature dielectric films such as Teflon and Mylar. Teflon is a DuPont trademark for polytetrofluoroethylene while Mylar is a DuPont trademark for its polyester.

Figure 6:
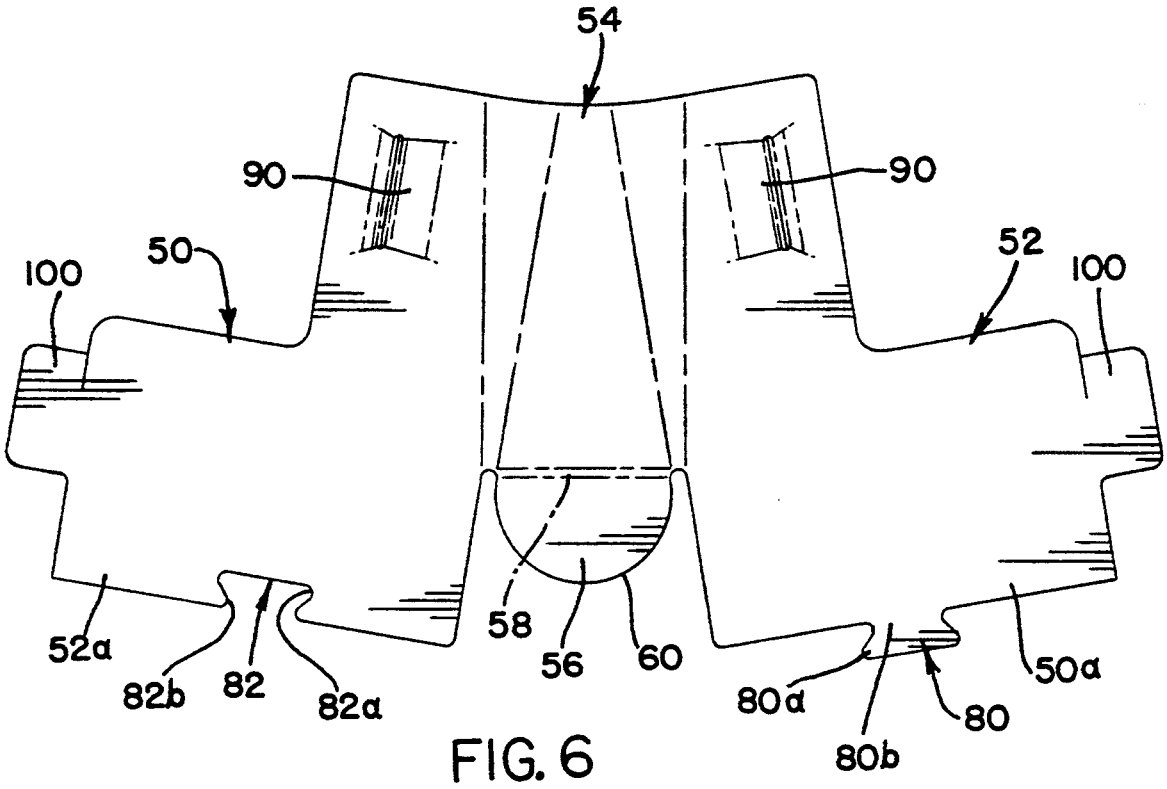
FIG. 6 is a plan view of the heat shield as it is stamped from flat metal stock and prior to its being folded to the shape shown in FIGS. 1–5.

It is likewise possible to use spray and powder coatings on the inside surfaces of the heat shield 20, such as Ryton, epoxy, silicone, fluoropolymers and enamels which can be applied either to a paper layer or directly onto portions of the heat shield 20 while it is still a flat blank, as shown in FIG. 6, prior to its being bent and formed. Applying such a coating or film to the flat blank, as shown in FIG. 6, would be an easy way to provide a dielectric barrier for three sides of the elastomeric boot 12.

The metal heat shield also includes a pair of arcuate, forwardly projecting ears 100 for engagement with the hex 32 of the metal shell 30 of the spark plug 22. This engagement provides both a heat conductive path to the engine block 24 and also a ground path for any electrical discharges. Thus, conduction of corona from the elastomeric boot 12 to the metal heat shield 20 by a path around the dielectric barrier 18 is significant because corona discharge through the dielectric barrier can cause a dramatic loss in dielectric strength of the dielectric barrier 18.

From the foregoing, it should be apparent that a novel, simple, inexpensive heat shield 20 for a preformed L-shaped elastomeric boot 12 has been provided. In addition, the elastomeric boot can be readily, snap fittingly attached to the heat shield 20 which reduces assembly time.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A heat shielded, spark plug boot assembly for an ignition cable connector comprising:

an L-shaped, tubular elastomeric boot having a cable end portion for receiving an ignition cable, a seal end portion for receiving a spark plug and sealing around its outer insulator part, and an intermediate cavity portion for housing a terminal having one end secured to one end of the ignition cable and its other end connectable to a terminal on a spark plug, an L-shaped heat shield mounted on said elastomeric boot and which surrounds said elastomeric boot for approximately 270′ of its circumference, said heat shield being stamped from flat sheet metal stock and then bent and formed to provide a pair of spaced apart, generally parallel L-shaped sides and a back between the sides and having a semicircular shaped upper end, said sides at upper end portions thereof being rolled toward and into engagement with each other to form said semi-circular shaped upper end and a longitudinal seam at their adjacent edges, said upper end portion of one side having a tab whose free end is wider than its base and the upper end portion of the other side having a complementary shaped recess whose bottom is wider than its mouth, said tab being received within said recess when said upper end portions of said sides are rolled toward each other to form said semi-circular shaped upper end to lock the sides together.

2. A heat shielded, spark plug boot assembly for an ignition cable connector comprising:

an L-shaped, tubular elastomeric boot having a cable end portion for receiving an ignition cable, a seal end portion for receiving a spark plug and sealing around its outer insulator part, and an intermediate cavity portion for housing a terminal having one end secured to one end of the ignition cable and its other end connectable to a terminal on a spark plug, an L-shaped heat shield mounted on said elastomeric boot and which surrounds said elastomeric boot for approximately 270′ of its circumference, said heat shield being stamped from flat sheet metal stock and then bent and formed to provide a pair of spaced apart, generally parallel L-shaped sides and a back extending transversely between said sides and having a semi-circular shaped upper end, said upper end of said back being indented to define a planar semi-circular area spaced slightly inwardly from the rest of said back, said sides at their upper end portions being rolled toward and into engagement with each other to form said semi-circular shaped upper end and a longitudinal seam at their free edges, said upper end portions engaging said upper semi-circular end of said back when in engagement with each other, said upper end portion of one side having a tab whose free end is wider than its base and the upper end portion of the other side having a complementary shaped recess whose bottom is wider than its mouth, said tab being received with said recess when said upper portions of said sides are rolled toward each other to form said semi-circular shaped upper end to lock the sides together, said elastomeric boot being connected to said heat shield by inserting the same into the heat shield from its open side.

3. A heat shielded, spark plug boot assembly, as defined in claim 2, and wherein said sides have indents for retaining said boot within said heat shield, said indents being spaced apart a distance which is less than an adjacent diameter of the boot whereby the boot is snap fitted past the indents on the sides.

4. A heat shielded, spark plug boot assembly for an ignition cable connector comprising:

an L-shaped, tubular elastomeric boot having a cable end portion for receiving an ignition cable, a seal end portion for receiving a spark plug and sealing around its outer insulator part, and an intermediate cavity portion for housing a terminal having one end secured to one end of the ignition cable and its other end connectable to a terminal on a spark plug, an L-shaped heat shield mounted on said elastomeric boot and which surrounds said elastomeric boot for 270′ of its circumference and which extends past the seal end portion of the elastomeric boot for engaging a ground member on a spark plug, said heat shield being stamped from flat sheet metal stock and then bent and formed to provide a pair of spaced apart, generally parallel L-shaped sides and a back extending transversely between said sides and having a semi-circular shaped upper end, said upper end of said back being indented to define a planar semi-circular area spaced slightly inwardly from the remainder of the back, said sides at their upper end portions being rolled toward and into engagement with each other to form semi-circular shaped upper end and a longitudinal seam at their free edges, said upper end portions engaging said upper semi-circular end of said back along its outer edge when rolled into engagement with each other, said upper end portion of one side having a tab whose free end is wider than its base and the upper end portion of the other side having a complementary shaped recess whose bottom is wider than its mouth, said tab being received with said recess when said upper portions of said sides are rolled toward each other to form semi-circular shaped upper end to lock the sides together, opposed indents on said sides which are spaced apart a distance less than an adjacent diameter portion of the boot, said indents retaining said boot within said heat shield when the boot is inserted into the heat shield from its open side and force fitted past the indents in said sides of said heat shield.

5. A heat shielded, spark plug boot assembly, as defined in claim 4, and further including a thin dielectric barrier located between the boot and the heat shield.

* * * * *